US007921750B2

(12) United States Patent
Pietras

(10) Patent No.: US 7,921,750 B2
(45) Date of Patent: Apr. 12, 2011

(54) POWER TONG FRAMES

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/432,059

(22) PCT Filed: Nov. 19, 2001

(86) PCT No.: PCT/GB01/05121

§ 371 (c)(1),
(2), (4) Date: May 15, 2003

(87) PCT Pub. No.: WO02/42600

PCT Pub. Date: May 30, 2002

(65) Prior Publication Data

US 2004/0035573 A1 Feb. 26, 2004

(30) Foreign Application Priority Data

Nov. 21, 2000 (GB) ..... 0028313.5

(51) Int. Cl.
*B25B 13/50* (2006.01)
*B25B 17/00* (2006.01)

(52) U.S. Cl. ..... 81/57.16; 81/57.24; 81/57.34; 81/57.35

(58) Field of Classification Search ..... 81/57.16, 81/57.15, 57.24, 57.26, 57.33, 57.34, 57.35, 81/57.4, 56.16
See application file for complete search history.

(56) References Cited

U.S. PATENT DOCUMENTS

| | | | | |
|---|---|---|---|---|
| 2,668,689 | A | 2/1954 | Cormany | 255/35 |
| 3,288,000 | A | 11/1966 | Foster | 81/57.34 |
| 3,803,953 | A | 4/1974 | Geczy et al. | 81/53 A |
| 3,857,451 | A | 12/1974 | Williams | 173/152 |
| 3,902,561 | A * | 9/1975 | Friberg et al. | 175/52 |
| 4,348,920 | A | 9/1982 | Boyadjieff | 81/57.25 |
| 4,445,403 | A * | 5/1984 | Janzen et al. | 81/57.18 |
| 4,581,956 | A * | 4/1986 | Robert | 81/57.38 |
| 4,727,781 | A * | 3/1988 | Yuehui et al. | 81/57.34 |
| 4,734,081 | A * | 3/1988 | Neathery et al. | 464/71 |
| 4,843,945 | A * | 7/1989 | Dinsdale | 81/57.34 |
| 5,060,542 | A * | 10/1991 | Hauk | 81/57.34 |
| 5,297,874 | A | 3/1994 | Raines | 384/221 |
| 5,495,782 | A * | 3/1996 | Ruessmann et al. | 81/57.39 |
| 5,791,206 | A * | 8/1998 | Daigle et al. | 81/57.33 |
| 5,868,045 | A * | 2/1999 | Hauk | 81/57.34 |
| 5,931,231 | A * | 8/1999 | Mock | 166/377 |
| 6,142,040 | A * | 11/2000 | Bouligny | 81/57.34 |
| 6,142,041 | A * | 11/2000 | Buck | 81/57.35 |
| 6,318,214 | B1 * | 11/2001 | Buck | 81/57.35 |

FOREIGN PATENT DOCUMENTS

| | | |
|---|---|---|
| GB | 2 009 705 | 6/1979 |
| GB | 2 201 912 | 9/1988 |
| WO | WO 82/00428 | 2/1982 |
| WO | WO 93/18276 | 9/1993 |
| WO | WO 98/32948 | 7/1998 |

* cited by examiner

*Primary Examiner* — Hadi Shakeri
(74) *Attorney, Agent, or Firm* — Patterson & Sheridan, LLP

(57) ABSTRACT

Apparatus for securing a joint between two lengths of tubular. The apparatus has a tong arrangement comprising a rotary tong and a back-up tong. The apparatus also includes a frame having a seat for supporting the tong arrangement from beneath, the tong arrangement resting upon the seat such that the tong arrangement can be oriented in use at an angle to the longitudinal axis of the frame. A support member is provided for securing the tong arrangement to the frame at a chosen orientation.

46 Claims, 5 Drawing Sheets

POWER TONG FRAMES

CROSS-REFERENCE TO RELATED APPLICATIONS

This application is the National Stage of International Application No. PCT/GB01/05121, filed Nov. 19, 2001, and published under PCT Article 21(2) in English, and claims priority of United Kingdom Application No. 0028313.5, filed on Nov. 21, 2000, which applications are herein incorporated by reference in their entirety.

BACKGROUND OF THE INVENTION

1. Field of the Invention

This invention relates to power tong frames.

2. Description of the Related Art

In the construction of oil or gas wells it is usually necessary to prepare extremely long drill pipes or strings. Due to the length of pipe required, sections or stands of pipe are progressively added to the pipe as it is lowered into the well from a drilling platform. In particular, when it is desired to add a section the pipe is usually restrained from falling into the well by applying the slips of a spider located in the floor of the drilling platform. The new section of pipe is then moved from a rack to the well centre above the spider. The threaded pin of the section of pipe to be connected is then located over the threaded box of the pipe in the well and the connection is made up by rotation therebetween. An elevator is connected to the top of the new section and the whole pipe lifted slightly to enable the slips of the spider to be released. The whole pipe is then lowered until the top of the pipe is adjacent the spider whereupon the slips of the spider are re-applied, the elevator disconnected and the process repeated.

It is common practice to use a power tong to torque the connection up to a predetermined torque in order to make this connection. The power tong is located on the platform, either on rails, or hung from a derrick on a chain. In order to make up or break out a threaded connection, a two tong arrangement may be used. An active (or wrenching) tong supplies torque to the section of tubular above the threaded connection, while a passive (or back up) tong supplies a reaction torque below the threaded connection. The back up tong clamps the tubular below the threaded connection, and prevents it from rotating. This clamping can be performed mechanically, hydraulically or pneumatically. The wrenching tong clamps the upper part of the connection and is driven so that it supplies torque for a limited angle. This power tong arrangement is also used to torque up connections between other tubulars, for example sections of casing and tubing.

Conventionally, power tongs including the two tong arrangement described above and other commercially available tongs are suspended by chains from a crane or other support. However, such chains can get in the way of other equipment, for example drill pipe spinners which are used to run in a threaded connection between sections of pipe prior to a final tightening of the connection with the wrenching and backup tongs.

SUMMARY OF THE INVENTION

It is an object of the present invention to provide a support for a power tong arrangement which reduces the overhead interference above the arrangement. It is a further object of the invention to support a power tong arrangement in such a way that the arrangement may be titled to allow its use with non-vertical tubular strings.

According to a first aspect of the present invention there is provided apparatus for securing a joint between two lengths of tubular, the apparatus comprising:

a tong arrangement comprising a rotary tong and a back-up tong;

a frame;

rigid support means coupled to the frame for supporting the tong arrangement such that the arrangement can be oriented in use at an angle to the longitudinal axis of the frame; and means for securing the tong arrangement to the frame at a chosen orientation.

Preferably, said rigid support means comprises a seat for supporting the tong arrangement from beneath. Preferably, the tong arrangement is supported on the seat such that the arrangement is able to move with respect to the seat in a substantially transverse plane, relative to the axis of the tubulars.

Preferably, said seat comprises means for tending to return the tong arrangement to a central position following deflection of the tong arrangement from that central position.

Preferably, the tong arrangement rests upon two or more support points of the seat. The support points, and/or the respective contact members on the tong arrangement which contact the support points each comprise a resilient member which provides a mechanism for tending to return the tong arrangement to a centre position following deflection of the tong. The resilient members may be of rubber or synthetic rubber, or may be helical or wound springs.

Preferably, said seat is substantially "V" shaped and lies in use in a substantially horizontal plane. Respective support points are located at the end of each leg of the seat and each comprises a part of a sphere or a spherical recess formed in a base member. Complimentary shaped parts or recesses are provided on the base of the tong arrangement for engagement with the support points on the seat. The radii of the part sphere and recess differ to allow relative transverse displacement of the tong arrangement and the seat. More preferably, the part spherical members or the base members in which the spherical recesses are formed are supported on resilient members to provide suspension for the tong arrangement.

Preferably, the tong arrangement is coupled to the frame, above said seat, by an elongate alignment member having a variable length. The orientation of the tong arrangement may be varied by varying the length of said elongate member. More preferably, the member comprises a hydraulically or pneumatically operated telescopic rod. Alternatively however, the member may be a chain.

Preferably, said seat is movable up and down said frame in order to allow the tong arrangement to be moved up and down.

According to a second aspect of the present invention there is provided a frame for supporting a tong arrangement comprising a rotary tong and a backup tong, the frame comprising:

rigid support means for supporting the tong arrangement such that the tong arrangement can be oriented in use at an angle to the longitudinal axis of the frame; and means for securing the tong arrangement to the frame at a chosen orientation.

Preferably, said rigid support means comprises a seat for supporting the tong arrangement from beneath.

According to a third aspect of the present invention there is provided apparatus for securing a joint between two lengths of tubular, the apparatus comprising:

a tong arrangement comprising a rotary tong and a back-up tong;

a frame;

rigid support means coupled to the frame for supporting the tong arrangement such that the arrangement can move to a limited extent relative to the support means in a plane transverse to the longitudinal axis of the tubulars; and means for securing the tong arrangement to the frame at a chosen orientation.

According to a fourth aspect of the present invention there is provided a frame for supporting a tong arrangement comprising a rotary tong and a backup tong, the frame comprising:

rigid support means coupled to the frame for supporting the tong arrangement such that the arrangement can move to a limited extent relative to the support means in a plane transverse to the longitudinal axis of tubulars to be connected; and means for securing the tong arrangement to the frame at a chosen orientation.

BRIEF DESCRIPTION OF THE DRAWINGS

Some preferred embodiments of the invention will now be described by way of example only and with reference to the accompanying drawings, in which.

DETAILED DESCRIPTION OF A PREFERRED EMBODIMENT

Figure 1:
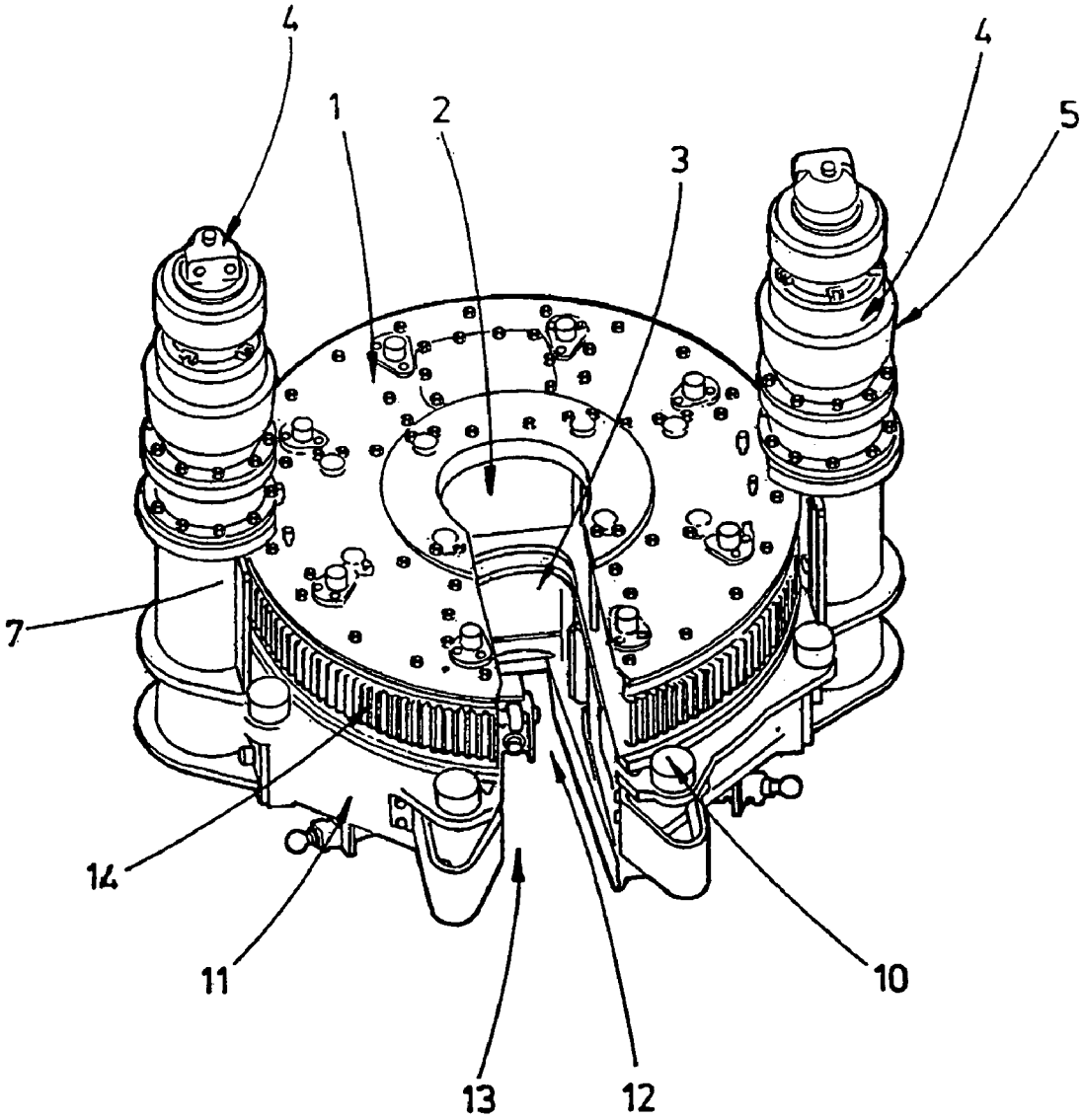
FIG. 1 is a view of an arrangement of a wrenching tong and a back-up tong.

FIG. 1 shows a power tong arrangement comprising a wrenching tong 1 and a back-up tong 11. This arrangement is the subject of co-pending British patent application number 9927825.1 filed Nov. 26, 1999, and published as GB 2370246 on Jun. 26, 2002. The wrenching tong 1 is generally in the form of a cylinder with an opening 2 through the centre thereof for receiving a stand of drill pipe (not shown), and a recess 3 running from the edge to the opening 2 at the centre.

The back-up tong 11 is located beneath the wrenching tong 1. The back-up tong is generally in the form of a disc with similar dimensions to the wrenching tong 1. The back-up tong is also provided with an opening 12 through the centre and a recess 13 from the edge to the opening at the centre. The opening 12 and recess 13 correspond to the opening 2 and recess 3 of the wrenching tong when the back-up tong 11 and the wrenching tong 1 are correctly aligned. A plurality of guide rollers 10 or other guide elements are spaced around the edge of the wrenching tong 1 in order to maintain the alignment of the wrenching tong 1 with the back-up tong 11.

The back-up tong 11 is provided with two pinion drives 4 arranged opposite each other at the periphery of the disc, equally spaced either side of the opening 12. Each pinion drive comprises a drive motor 5, drive shaft (not shown) and pinion (hidden in FIG. 1 but indicated generally by the numeral 7) attached to the drive shaft. A gear 14 is provided around the periphery of the wrenching tong 1, broken by the recess 3. The gear 14 meshes with the pinions attached to the motors 5 on the back-up tong, so that when the drive motors 5 drive the drive shafts and pinions 7, the wrenching tong 1 rotates relative to the back-up tong 11. The angle of rotation is limited by the recess 3 of the wrenching tong 1.

Three clamping jaws (not shown) are located inside each of the wrenching tong 1 and back-up tong 11 as illustrated in FIG. 1. These are hydraulically driven for clamping the drill pipe stand in place in the centre of the wrenching tong. The hydraulic power supply may be provided by hoses (not shown).

Figure 2:
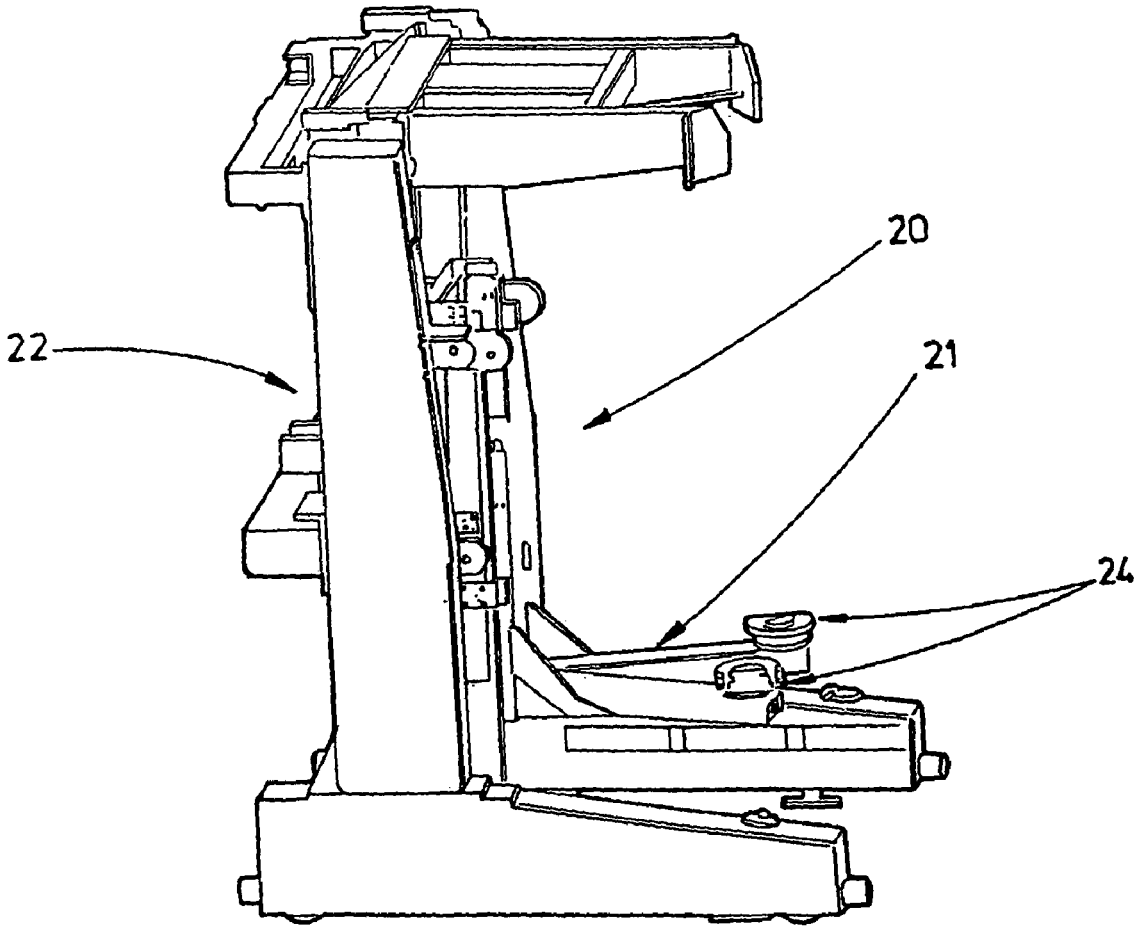
FIG. 2 is a side view of a frame for supporting the tong arrangement of FIG. 1.
Figure 3:
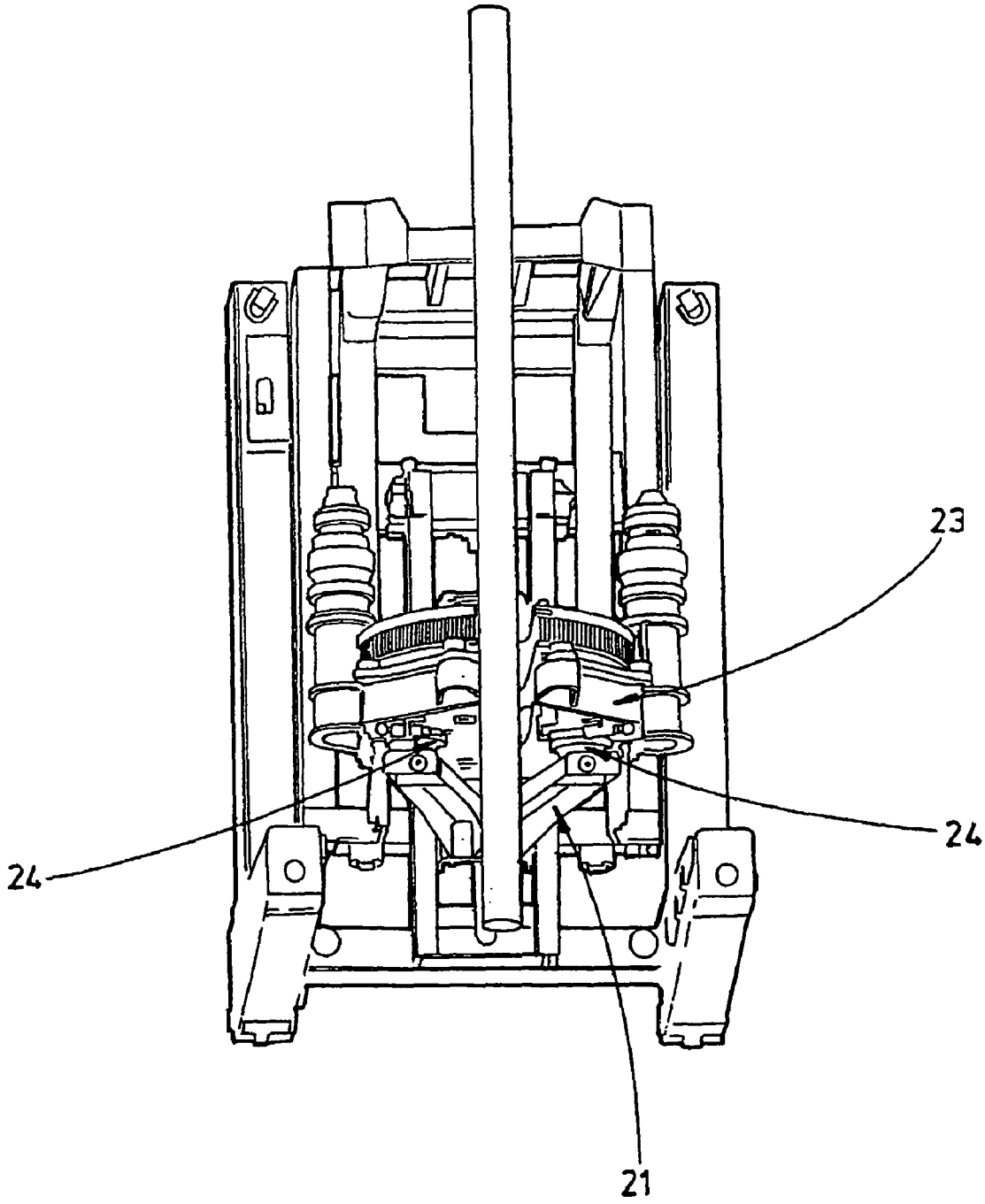
FIG. 3 is a front view of the frame of FIG. 2, with a wrenching tong in place.

FIG. 2 illustrates a frame 20 for supporting a tong arrangement. The frame 20 comprises a "V" shaped seat 21 which lies in a horizontal plane and can be raised and lowered relative to the frame upright section 22. FIG. 3 illustrates a tong arrangement 23, such as that described with reference to FIG. 1, located in the frame 20 and supported on the seat 21 so that substantially all of the weight of the tong arrangement 23 is borne by the frame 20 via the seat 21.

At the end of each leg of the seat 21 there is arranged a support unit 24. One such support unit is illustrated in more detail in FIG. 4. Each support unit 24 comprises a bearing 25 having a part spherical upper portion 26. In contact with the part spherical portion 26 is a base member 27 having a spherically shaped recess 28 formed therein. A flange 29 is secured to the base member 27 and rests upon an annular rubber member 30 which surrounds the bearing 25. The base members 27 are secured to the base of the tong arrangement 23.

It will be understood that the base member 27 is at all times in contact with the top of the bearing 25. When the tong arrangement is deflected from the horizontal plane in which the seat 21 is located, the rubber member 30 is compressed on one side by the weight of the tong arrangement. The reaction force produced by the member 30 on the tong arrangement tends to push the tong arrangement back to its central position. The support mechanism comprising the seat 21 and the support units 24 helps to secure the tong arrangement against the effects of vibrations whilst the wrenching tong is rotating.

Figure 4:
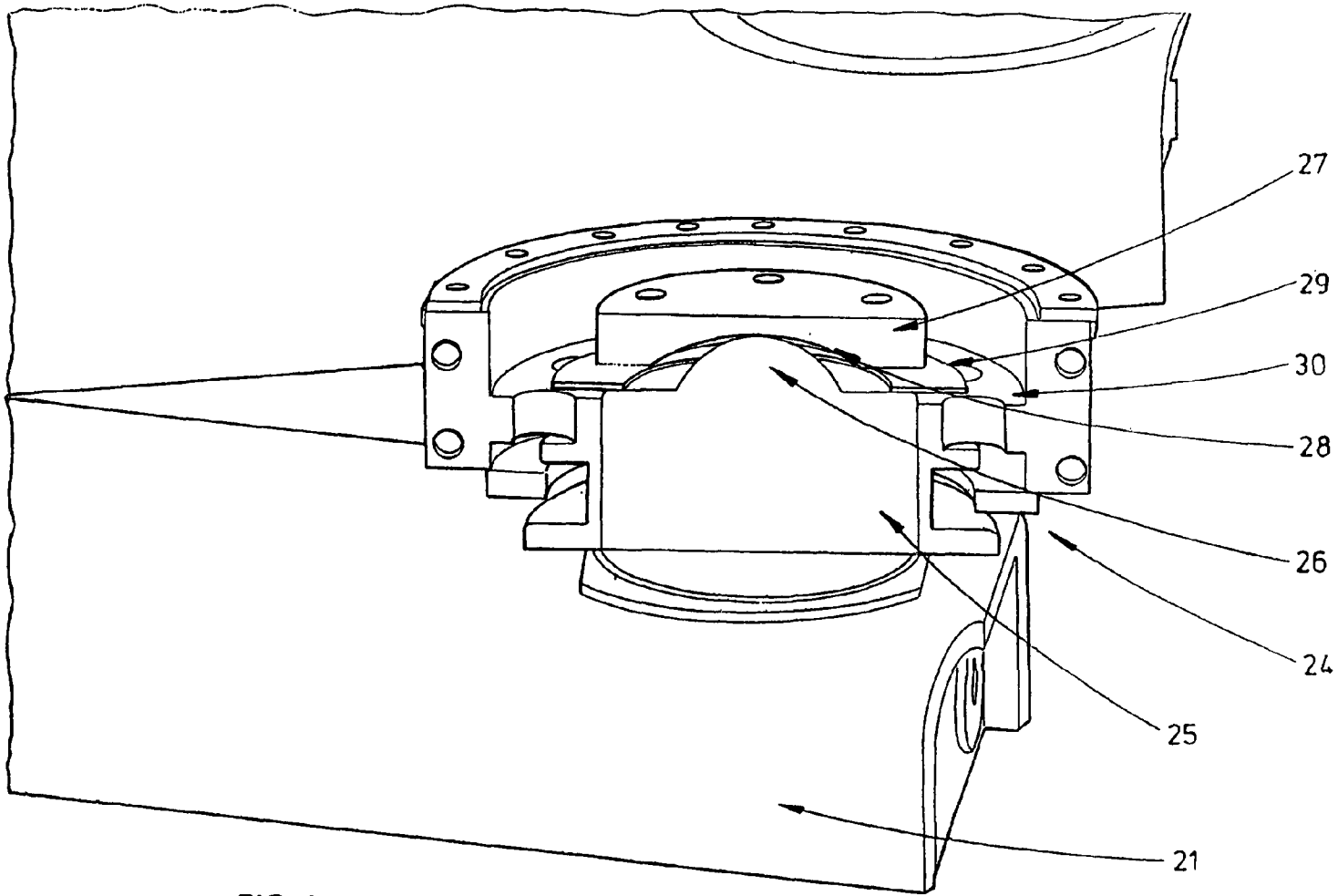
FIG. 4 shows in more detail a support point of the frame of FIGS. 2 and 3.

As illustrated in FIG. 4, the radius of the spherical recess 28 is greater than that of the spherical portion 26 on which it is supported. This allows the tong arrangement 23 to move (or float) in a substantially horizontal plane, relative to the seat 21 and frame 20. Typically, the dimensions of the various components are such as to allow several centimeters of relative movement such as is required during the gripping of a drill pipe in order to avoid problems which will arise when the frame is not correctly aligned with the drill pipe. The ability of the tong arrangement to "float" above the seat also prevents damage resulting from movement of the backup tong during operation of the tong arrangement.

Figure 5:
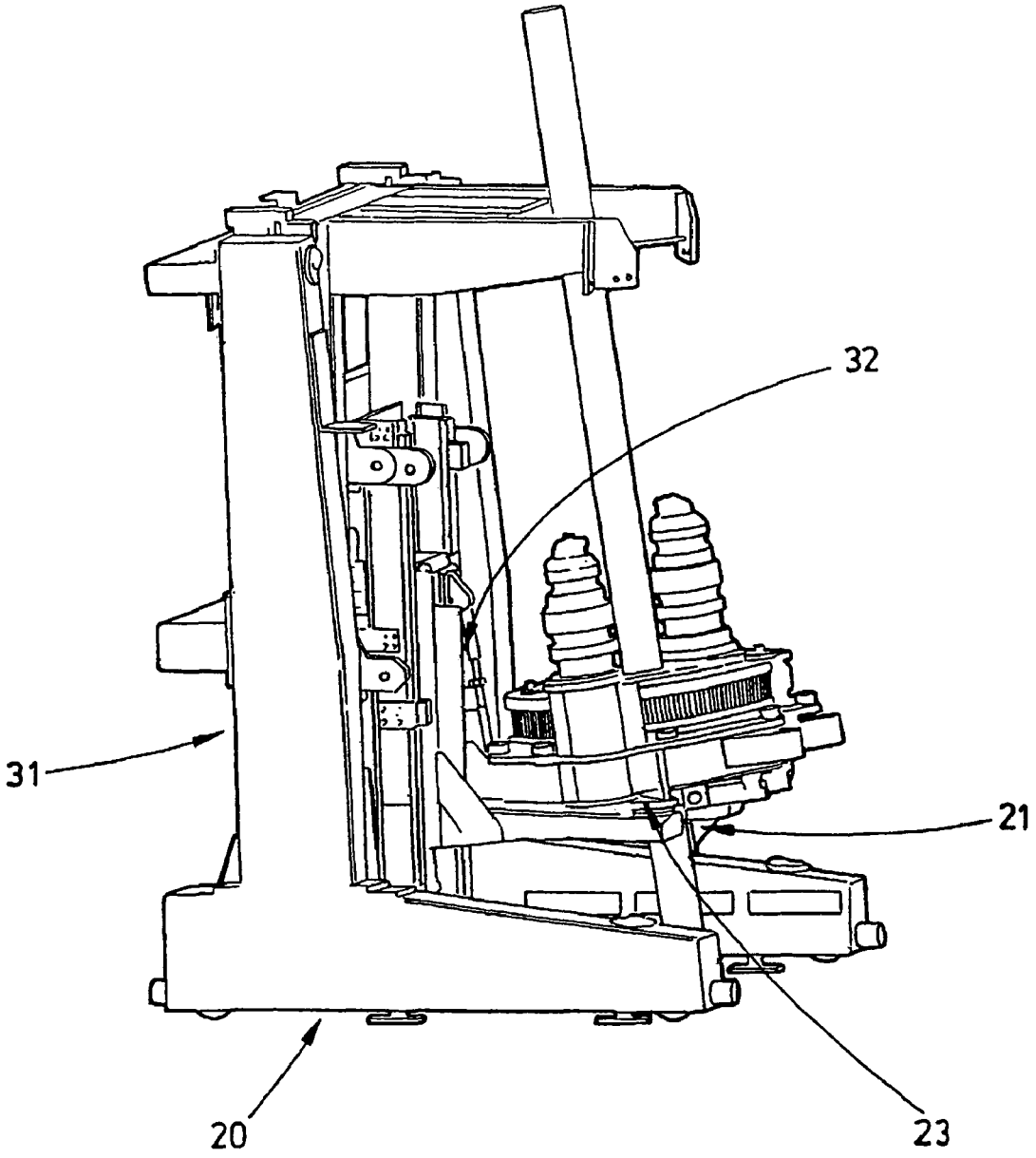
FIG. 5 shows a side view of the frame of FIG. 2, with a wrenching tong in place and tilted at an angle to the vertical.

FIG. 5 illustrates the frame 20 of FIGS. 2 to 4, with the tong arrangement 23 being coupled to an upright member 31, which is attached to the seat 21 at right angles thereto. The upright member 31 moves up and down in the frame 20 with the seat 21. More particularly, the tong arrangement 23 is coupled to the upright member 31 by a hydraulically or pneumatically driven rod 32. The rod 32 is coupled at its ends to the tong arrangement 23 and the upright member 31 by respective pivotable joints. By extending and retracting the rod 32, it is possible to vary the alignment of the tong arrangement 23 with respect to the vertical axis and to hold the tong arrangement in the desired position against the reaction force of the rubber member 30. When the power which actuates the rod 31 is switched off, the tong arrangement will return to its central position.

The frame of FIGS. 2 to 5 is suitable for use in situations where the well being drilled is at an angle to the vertical. By avoiding the need for chains to support the tong arrangement from above, the overall height of the frame is reduced compared to conventional frames. In addition, it is easier to introduce tools above the tong arrangement, for example a drill pipe spinner, because chains are no longer present in this area.

It will be appreciated by the person of skill in the art that various modifications may be made to the above described embodiment without departing from the scope of the present invention. For example, rather than providing a seat to support the tong arrangement from underneath, the tong arrangement may be held by some other rigid support means which grips or is attached to the sides or top of the tong arrangement.

The invention claimed is:

1. A frame for supporting a tong assembly for handling a tubular, comprising:

a seat coupled to an upright section; and a support unit disposed on the seat, wherein the support unit comprises a base member supported on a bearing, wherein the bearing is adapted to engage a spherical recess of the base member, the spherical recess having a radius greater than a radius of the bearing, wherein the tong assembly is disposed on and in contact with the support unit, wherein the support unit is adapted to allow the tong assembly to move relative to the seat in a substantially transverse plane relative to a longitudinal axis of the tubular.

2. The frame of claim 1, wherein the seat is adapted to position the tong assembly at the proper angle for alignment with the tubular.

3. The frame of claim 1, wherein the seat is movable vertically along the upright section.

4. The frame of claim 1, wherein the seat is movable away from the upright section.

5. The frame of claim 1, wherein the frame is movable to and from the tubular.

6. The frame of claim 1, wherein the seat is V shaped.

7. The frame of claim 1, further comprising an extendible motive member for coupling the seat to the upright section.

8. The frame of claim 7, wherein actuation of the extendible motive member positions the tong assembly in alignment with the tubular.

9. The frame of claim 1, wherein the difference in the radii of the base member and the bearing allows the movement in the transverse plane.

10. The frame of claim 1, further comprising a resilient member disposed around the bearing.

11. The frame of claim 1, further comprising an alignment member for angling the tong assembly with respect to a vertical axis.

12. The frame of claim 1, wherein the support unit comprises a resilient member that is adapted to return the tong assembly to an initial position in response to movement of the tong assembly.

13. The frame of claim 12, wherein return of the tong assembly is caused by a reaction force of the resilient member.

14. A frame for supporting a tong assembly for handling a tubular, comprising:

a seat coupled to an upright section; and a support unit disposed on the seat, wherein a base of the tong assembly includes a concave surface that is in contact with a convex surface of the support unit to allow the tong assembly to move in a substantially transverse plane relative to a longitudinal axis of the tubular, and wherein the support unit includes a resilient member configured to provide a reaction force to the tong assembly to return the concave surface of the tong assembly to a central position on top of the convex surface of the support unit.

15. The frame of claim 14, further comprising a structural intermediate for coupling the seat to the upright section.

16. The frame of claim 15, wherein the structural intermediate is adapted to move the seat vertically along the upright section.

17. The frame of claim 15, wherein the structural intermediate comprises an extendible motive member.

18. The frame of claim 15, wherein the structural intermediate is adapted to raise or lower the seat.

19. The frame of claim 14, further comprising an alignment member for varying the alignment of the tong assembly with respect to a vertical axis.

20. A tong positioning apparatus for handling a tubular, comprising:

a tong; and a frame for supporting the tong, the frame comprising:

a seat coupled to an upright section; and a support unit disposed on the seat, wherein the tong is supported on and in contact with the support unit and having an initial position with respect to the seat, wherein the support unit is adapted to allow the tong to move relative to the seat in a substantially transverse plane relative to a longitudinal axis of the tubular and is adapted to generate a reaction force to return the tong to the initial position in response to the relative movement of the seat, wherein the support unit comprises a base member supported on a bearing, wherein the bearing engages a spherical recess of the base member and wherein a radius of the spherical recess is greater than a radius of the bearing.

21. The tong positioning apparatus of claim 20, further comprising an alignment member for varying the alignment of the tong with respect to a vertical axis.

22. The tong positioning apparatus of claim 20, wherein the seat is adapted to position the tong at the proper angle for alignment with the tubular.

23. The tong positioning apparatus of claim 20, wherein the difference in the radii of the base member and the bearing allows the movement in the transverse plane.

24. A frame for supporting a tong assembly for handling a tubular, comprising:

a seat coupled to an upright section; and a support unit disposed on the seat, wherein the support unit comprises a base member supported on a bearing, wherein the bearing is adapted to engage a spherical recess of the base member, the spherical recess having a radius greater than a radius of the bearing to allow movement of the tong assembly in a transverse plane, wherein the tong assembly is supported on the seat and the support unit.

25. The frame of claim 24, wherein the support unit is adapted to allow the tong assembly to move relative to the seat in a substantially transverse plane relative to a longitudinal axis of the tubular.

26. A tong positioning apparatus for handling a tubular, comprising:

a tong; and a frame for supporting the tong, the frame comprising:

a seat coupled to an upright section; and a support unit disposed on the seat, wherein the support unit comprises a base member supported on a bearing, wherein the bearing is adapted to engage a spherical recess of the base member, the spherical recess having a radius greater than a radius of the bearing to allow movement of the tong in a transverse plane;

wherein the tong is supported on the seat and the support unit.

27. A frame for supporting a tong assembly for handling a tubular, comprising:

a seat coupled at its proximate end to an upright section, wherein the seat is movable at its proximate end along a longitudinal axis of the upright section; and a support unit disposed on a distal end of the seat, wherein the tong assembly includes a spherical bottom surface that engages a spherical upper surface of the support unit to allow the tong assembly to move in a transverse plane relative to a longitudinal axis of the tubular, and wherein the support unit includes an elastic member configured to reactively move the tong assembly to a central position on top of the support unit.

28. The frame of claim 27, wherein the seat comprises at least two oblique extension portions.

29. The frame of claim 27, wherein the support unit is cylindrically-shaped.

30. The frame of claim 27, wherein the frame is movable to and from the tubular.

31. The frame of claim 27, further comprising an alignment member for varying the alignment of the tong assembly with respect to a vertical axis.

32. The frame of claim 27, wherein the support unit comprises a bearing having the spherical upper surface, and wherein the elastic member is disposed around the bearing.

33. The frame of the claim 32, wherein the spherical bottom surface is part of a base member that is coupled to the base of the tong assembly.

34. The frame of the claim 33, wherein the base member is part of the tong assembly.

35. The frame of the claim 33, wherein the base member is part of the support unit.

36. A frame for supporting a tong assembly for handling a tubular, comprising:

a seat coupled to an upright section; and a support unit disposed on the seat and operable to support the tong assembly, wherein the support unit comprises a bearing having a convex portion adapted to engage a concave surface to allow movement of the tong assembly in a transverse plane, and wherein the support unit further comprises a resilient member that applies a reaction force to return the tong assembly to a central position on the support unit following deflection of the tong assembly from the central position in the transverse plane.

37. The frame of claim 36, wherein the seat is V shaped.

38. The frame of claim 36, wherein the seat is movable vertically along the upright section.

39. The frame of claim 36, further comprising an alignment member for varying the alignment of the tong assembly with respect to a vertical axis.

40. The frame of claim 36, wherein the frame is movable to and from the tubular.

41. The frame of claim 36, wherein the seat is adapted to position the tong assembly at a proper angle for alignment with the tubular.

42. The frame of claim 36, wherein the concave surface has a radius greater than the radius of the convex portion.

43. The frame of claim 42, wherein the difference in the radii of the concave surface and the convex portion allows the movement in the transverse plane.

44. A frame for supporting a tong assembly for handling a tubular, comprising:

a base member coupled to the tong assembly and having a concave surface;

a seat coupled to an upright section; and a support unit fixed to the seat and having a convex surface, wherein the base member is disposed on the support unit such that the concave surface is in contact with the convex surface to allow lateral movement of the tong assembly relative to the seat, and wherein the support unit further includes a resilient member surrounding the convex surface and configured to provide a reaction force in response to movement of the tong assembly.

45. The frame of claim 44, wherein the base member includes a flanged portion in contact with the resilient member to support the tong assembly on the support unit.

46. A frame for supporting a tong assembly for handling a tubular, comprising:

a seat coupled to an upright section; and a support unit having a bearing coupled to the seat, wherein the bearing includes an upper convex surface for supporting the tong assembly from beneath, wherein the upper convex surface is in contact with a concave surface that is positioned on top of the upper convex surface to allow movement of the tong assembly in a transverse plane, and wherein the concave surface is movable with the tong assembly in the transverse plane relative to the bearing and the seat, and wherein the support unit further includes a resilient member coupled to the bearing that provides a reaction force in response to transverse movement of the tong assembly.

* * * * *